US008959704B1

(12) United States Patent
Pena

(10) Patent No.: US 8,959,704 B1
(45) Date of Patent: Feb. 24, 2015

(54) DEBRIS COLLECTION DEVICES

(71) Applicant: Christopher Pena, San Juan, TX (US)

(72) Inventor: Christopher Pena, San Juan, TX (US)

(73) Assignee: Christopher Peňa, San Juan, TX (US)

( * ) Notice: Subject to any disclaimer, the term of this patent is extended or adjusted under 35 U.S.C. 154(b) by 21 days.

(21) Appl. No.: 13/815,350

(22) Filed: Feb. 25, 2013

Related U.S. Application Data

(60) Provisional application No. 61/744,442, filed on Sep. 26, 2012.

(51) Int. Cl.
*A47L 13/52* (2006.01)
*B65B 67/12* (2006.01)
*B65F 1/14* (2006.01)

(52) U.S. Cl.
CPC ..... *B65F 1/14* (2013.01); *B65F 1/1473* (2013.01)
USPC ..... 15/257.1; 15/257.3; 15/257.6; 248/99

(58) Field of Classification Search
USPC ..... 15/257.1, 257.3, 257.6, 257.9; 248/99
See application file for complete search history.

(56) References Cited

U.S. PATENT DOCUMENTS

| | | | | |
|---|---|---|---|---|
| 2,902,705 | A * | 9/1959 | Eistrup | 15/1.7 |
| 5,031,277 | A * | 7/1991 | Coker | 15/257.3 |
| 5,393,022 | A * | 2/1995 | Palumbo | 248/95 |
| 5,593,117 | A * | 1/1997 | Alexander, III | 248/99 |
| 6,318,419 | B1 * | 11/2001 | Lee | 141/108 |
| 6,708,742 | B2 * | 3/2004 | Weathers et al. | 141/391 |
| D567,465 | S * | 4/2008 | Lucker | D34/6 |
| 7,490,787 | B1 * | 2/2009 | Salazar | 241/62 |
| 7,806,593 | B2 * | 10/2010 | Toporski | 383/33 |
| 2008/0052869 | A1 * | 3/2008 | Fanning | 15/347 |

* cited by examiner

*Primary Examiner* — Randall Chin

(57) ABSTRACT

Provided herein are devices which facilitate collection of debris from various locations, such as roads, driveways, and fields. An article provided in accordance with some embodiments includes a receiver with an opening suitable for admitting debris, and also having panels connected thereto which assist in directing debris into the opening of the receiver. An adapter body having a proximal end attached to the receiver permits debris to pass through the adapter body to the distal end of the adapter body, and the distal end is fitted with a collection receptacle, which receptacle comprises a sack, bag or the like that contains perforations or holes sufficiently dimensioned to enable air to pass through the wall of the sack, bag, or the like, while retaining debris within the interior volume of the sack, bag, or the like.

9 Claims, 13 Drawing Sheets

DEBRIS COLLECTION DEVICES

CROSS-REFERENCE TO RELATED APPLICATIONS

This application claims the benefit of priority of U.S. Provisional Application No. 61/744,442 filed on Sep. 26, 2012, the entire contents of which are hereby incorporated by reference herein.

TECHNICAL FIELD

This invention relates generally to debris collection More particularly, it relates to devices useful for manipulating debris using a leaf-blower or other forced-air device, to blow debris into a desired location for ease of collection and removal.

BACKGROUND OF THE INVENTION

The statements in this background section merely provide background information related to the present disclosure and may not constitute prior art.

Devices useful for providing forced-air are in widespread use and include any device that emits a stream of air that is of sufficient force capable to move debris from a first location on a horizontal surface such as concrete, asphalt, and the ground to a second location. Such devices include gasoline or electrically operated hand-held "leaf blowers" which are capable of causing the motion of leaves, small stones, dirt, trash and other sundry items when the air stream they emit is directed towards such debris.

BRIEF DESCRIPTION OF THE DRAWINGS

The drawings described herein are for illustration purposes only and are not intended to limit the scope of the present disclosure in any way.

INVENTION SUMMARY

Provided hereby are devices useful for collecting leaves and other ground debris under the influence of a forced stream of air. Devices according to some embodiments of the invention comprise an adapter body having a wall, a proximal end, and a distal end, and each of the ends are at the terminus of an opening of a tapered interior conduit or bore, the interior conduit having an interior wall. There is a receiver portion having an opening suited to receiving debris and configured to provide the debris to the proximal end of the adapter body, the opening having a left side, a right side, and a bottom portion. There is a first panel attached to the receiver at the left side of the opening and a second panel attached to the receiver at the right side of the opening. The distal end of the adapter body is configured to receive and maintain a collection receptacle in a fixed position about the distal end of the adapter body, with the entire foregoing arrangement being sufficient to enable debris forced to enter the opening of the receiver under the influence of a stream of air to be directed into the collection receptacle.

DETAILED DESCRIPTION

The following description is merely exemplary in nature and is in no way intended to limit the present disclosure, application, or uses.

Figure 1:
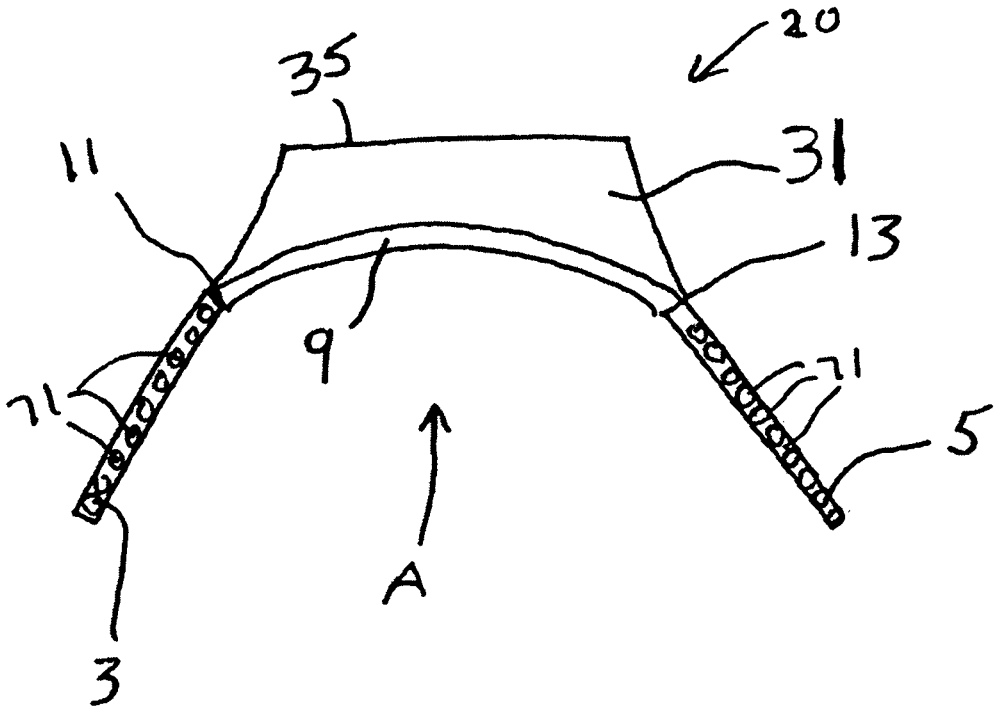
FIG. 1 is an overhead view of a collection manifold useful in accordance with some embodiments of the invention.

Referring now to the drawings, and initially to FIG. 1, there is shown an overhead view of a collection manifold 20 useful in accordance with some embodiments of the invention. Shown in FIG. 1 is an adapter body 31 having an opening 9 at its proximal end, and a distal end 35. Attached to the left side of adapter body 31 at 11 is left panel 3. There is a right panel 5 attached at 13 to the right side of adapter body 31. In some embodiments, left panel 3 is hingedly attached at 11 to adapter body 31, and right panel 5 is in some embodiments hingedly attached at 13 to adapter body 31. In some embodiments, left panel 3 and right panel 5 each include a plurality of holes 71 disposed through them, as more clearly shown in FIG. 2. When present, the purpose of these holes 71 is to enable the panels 3, 5 to function effectively as a "net", to enable air blown in the direction indicated by the arrow labeled A by a leaf blower or the like to pass through the panels 3, 5 whilst debris is retained in front of the panels. By angling the panels 3, 5 at an angle of about 130°, the movement of the debris and is actually directed into opening 9 upon the influence of a leaf blower or the like. Any angle or range of angles of attachment between about 100° and about 170 degrees to the flat or substantially flat front portion of adapter body 31 at opening 9 is suitable for attachment of panels 3, 5 thereto. Hinged attachments at either or both of 11, 13 can provide for variable adjustability of this angle to suit a user's desires.

Figure 2:
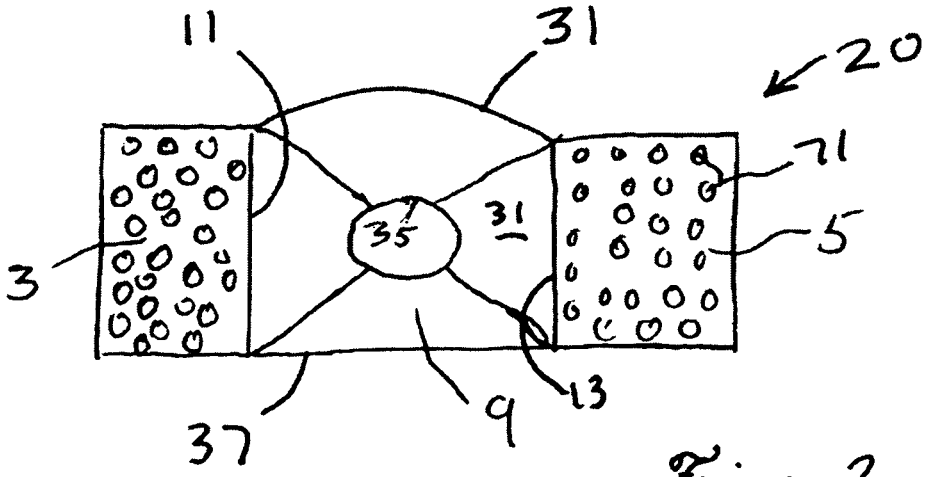
FIG. 2 is a side view of a collection manifold useful in accordance with some embodiments of the invention.

In FIG. 2 is shown a side view of a collection manifold 20 useful in accordance with some embodiments of the disclosure, showing the respective locations of the left panel 3 attached to adapter body 31 at 11, and right panel 5 attached to adapter body 31 at 13. The distal end 35 of the adapter body 31 is shown, as well as a plurality of holes 71 disposed through both left panel 3 and right panel 5. The bottom 37 of adapter body 31 in some embodiments comprises a flat surface to enable adapter body 31 to reside on a flat surface such as a road, parking lot, driveway, etc., for articles of the various embodiments provided herein when selected to have no wheels. Thus, a device as provided herein can optionally comprise zero, two, or four wheels.

Figure 3:
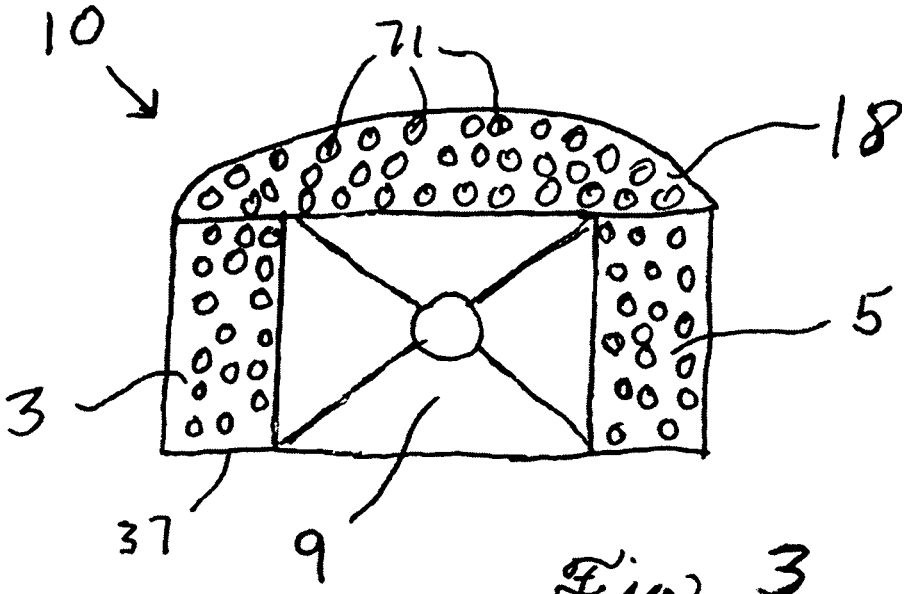
FIG. 3 is a side view of a collection manifold having a collection receptacle attached thereto useful in accordance with some embodiments of the invention.

FIG. 3 shows a side view of a combination 10 including collection manifold 31 having a collection receptacle 18 attached thereto, useful in accordance with some embodiments of the disclosure. In some embodiments the collection receptacle 18 is a bag (such as a plastic trash bag, well-known in the art) comprising a plurality of holes disposed through the walls of such collection receptacle. For a combination 10 as shown that is disposed with its bottom 37 on a flat surface near ground debris, such a feature enables the air stream directed from a leaf blower or the like to force debris up against angled panels 3, 5, which forces or directs it and other debris in the vicinity into opening 9, from where it passes through adapter body 31 (FIGS. 1, 2) and into the collection receptacle 18. Holes 71 in the collection receptacle enable the passage of air, but not debris of a size larger than the openings. In this fashion movement of debris is facilitated by enabling passage of air through the combination 10 of FIG. 3. The collection receptacle 18 can be of any suitable material, including any polymeric materials, plastics, canvas, and cargo net materials known to be useful in providing trashbags, sacks, bags, pouches or the like, as well as fabric bags made from cotton or any other natural or synthetic fibrous or non-fibrous material, including both woven and non-woven fabrics. Collection receptacle 18 is affixed to adapter body 31 by any conventional method of attachment, including providing adapter body 31 with provision for enabling a drawstring to be affixed about its distal end 35, a zippered attachment, snaps, adhesives, clamps, clips, hooks or any other known combination useful for attaching a bag to a funnel-like receptacle. In some embodiments the provision is a lip or channel present at the distal end of the tapered interior wall of the adapter body. The average size of the holes in collection receptacle 18 can be any opening between about one millimeter and about 25 millimeters, including all sizes and ranges of sizes therebetween, or larger, depending on the nature of the debris that is desired to be collected.

Figure 4:
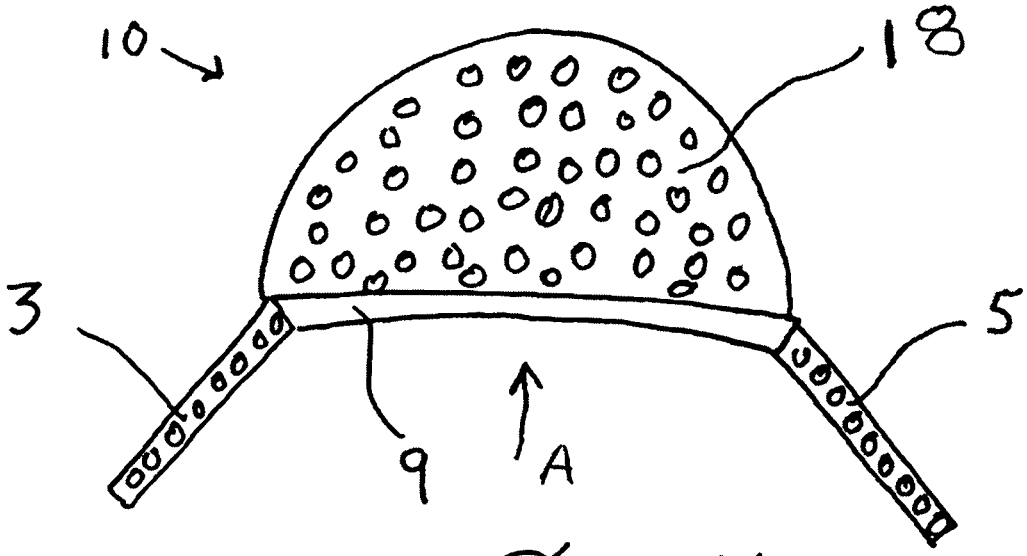
FIG. 4 is an overhead view of a collection manifold having a collection receptacle attached thereto useful in accordance with some embodiments of the invention e.

FIG. 4 shows is an overhead view of a combination 10 including collection manifold 20 (FIG. 1) having a collection receptacle 18 attached thereto, useful in accordance with some embodiments of the disclosure. Arrow A shows the general direction of an applied stream of air into opening 9, and the respective locations of panels 3, 5 each having a plurality of holes disposed therethrough for passage of air are shown.

Figure 5:
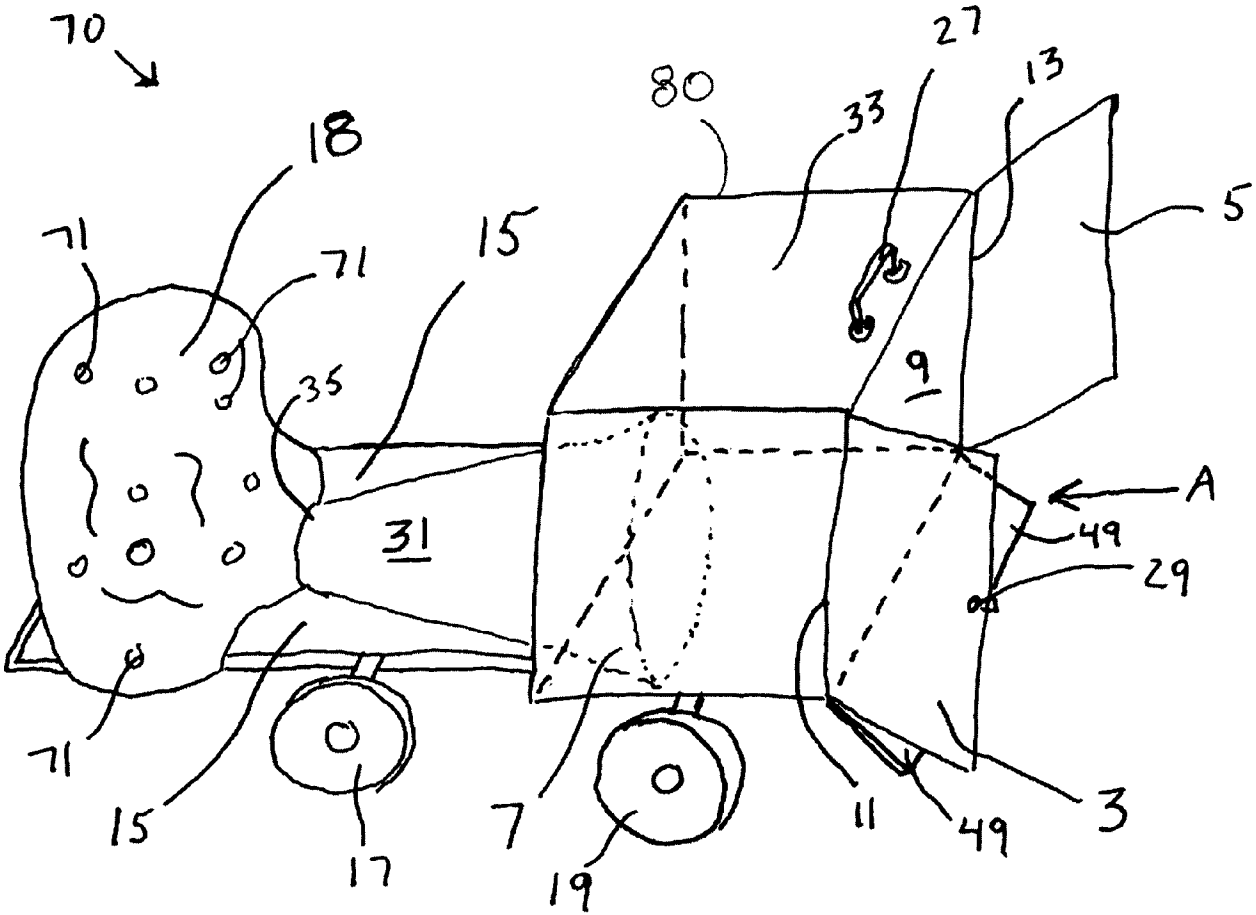
FIG. 5 is a perspective view of a wheeled device embodying concepts of the invention.

FIG. 5 shows a perspective view of a wheeled device 70 embodying concepts of some embodiments of the present invention. Device 70 includes a flat and optionally a substantially-flat base 15 that is provided with wheels 17, 19 disposed on axles, casters and the like being optional. Attached to the wheeled base is an adapter body 31 that is generally shaped as a funnel. Adapter body 31 has a proximal end 7 and a distal end 35. In this non-limiting exemplary embodiment, the proximal end 7 of the adapter body 31 is disposed in a box or a box-like receiver having a top surface 33. The receiver comprises panels 3, 5 attached at its end that provides an opening 9 when panels 3, 5 are in a swung-open position. The proximal end 7 of adapter body 31 is disposed within the receiver 80 and in some embodiments proximal end 7 is circular, however any other geometric shape for proximal end 7 is within the scope of this disclosure. It is typically desirable according to this disclosure that the perimeter of proximal end 7 is sealed to the inner contour of receiver 80 so as to permit no debris to pass outside the receiver 80 once it has entered receiver 80, other than the debris to pass through the distal end 35 of adapter body 31 and into collection receptacle 18. Such sealing can include stuffing (or otherwise filling) any material between the inner contours of receiver 80 and the contour/perimeter at the proximal end 7 of the adapter body 31. In some embodiments, the wall of the box or box-like receiver at which the proximal end 7 is present itself is or functions as, the proximal end, the remaining elements of adapter body 31 being contoured accordingly and functioning in some embodiments as an extension of the proximal end 7. In some embodiments, receiver 80 has a floor portion, a left wall, a right wall, and a rear wall, in addition to panels 3, 5 which collectively function as a front wall when both are closed. In various embodiments of the invention, any of the floor portion, left wall, right wall, top portion 33, rear wall (at intersection of proximal end 7 with receiver 80), and panels 3, 5 and the adapter body 31 may be optionally provided with a plurality of holes disposed through any one or any combination including more than one of these elements, to facilitate passage of air therethrough while retaining debris.

In some embodiments receiver 80 is provided with a ramp 49 at the bottom or bottom edge of opening 9, to interface with a horizontal surface upon which device 70 rests, to enable debris to be blown up such ramp 49, into receiver 80 and ultimately to collection receptacle 18. Receiver 80 is optionally provided with a handle 27 attached thereto at any desired location thereon, although in some embodiments a handle 27 is attached to the adapter body 31. A conventional latch 29 is optionally provided for keeping panels 3, 5 in a closed position when device 70 is not in use. In some embodiments ramp 49 is hingedly attached to receiver 80 and can be flipped up prior to closing panels 3, 5 for convenient storage. In various alternate embodiments, any one or more than one of the panels from which receiver 80 is comprised is hingedly attached to the remaining portions of receiver 80, to enable such hingedly attached panel to be opened for the purpose of inspection or cleaning debris from any location within the receiver 80. In other alternate embodiments, any one or more than one of the panels from which receiver 80 is comprised is slidably mounted to the remaining panels, such as by for example by grooves being present in panels disposed at opposite ends of such slidably mounted panel, to enable such slidably mounted panel to be slid open (akin to how a common drawer is slid open and closed) for the purpose of inspection or cleaning debris from any location within the receiver 80. The use of any conventional hardware known to those skilled in the art configured to enable such slidable mounting of any one or more than one panel of receiver 80 is within the scope of use in various embodiments of the invention.

In some embodiments an adapter body 31 useful in accordance with this disclosure is shaped to function as a funnel, insomuch in many embodiments the cross sectional area at the proximal end 7 is larger than the cross sectional area at the distal end 35, just as a funnel has a larger open end on one side and a smaller opening at its portion through which the admitted substance is intended to exit.

For elements of the present disclosure which feature a plurality of holes, the present disclosure contemplates any number of holes, disposed at any location described herein, in any pattern and of any size or area of coverage of such holes that is effective for debris collection as provided herein.

Figure 6:
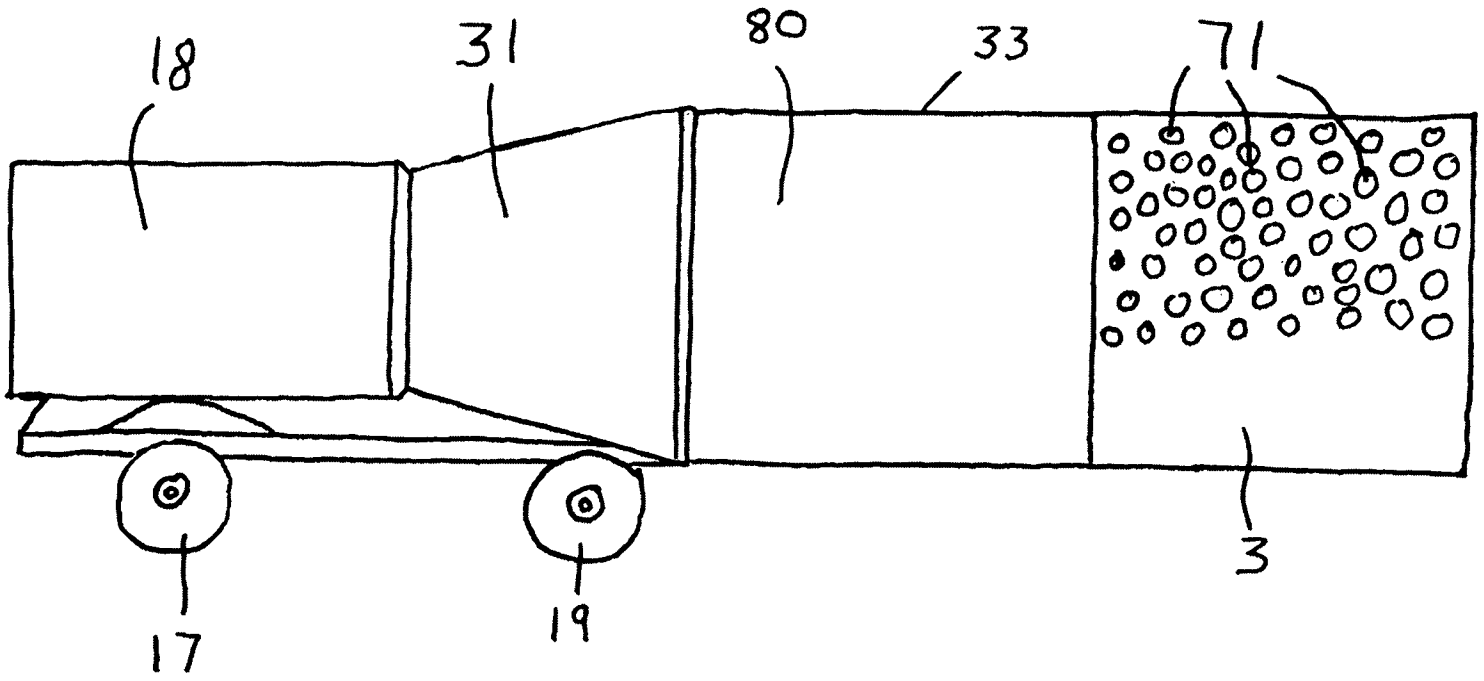
FIG. 6 is a left side view of a wheeled device embodying concepts of the invention.

FIG. 6 is a left side view of a wheeled device embodying the concepts of the present disclosure, wherein adapter body 31 is not shaped as a funnel as shown in FIG. 5, but its rather dimensioned so that its proximal end matches the contour of the receiver 80 at their juncture, in some embodiments provided by the invention.

Figure 7:
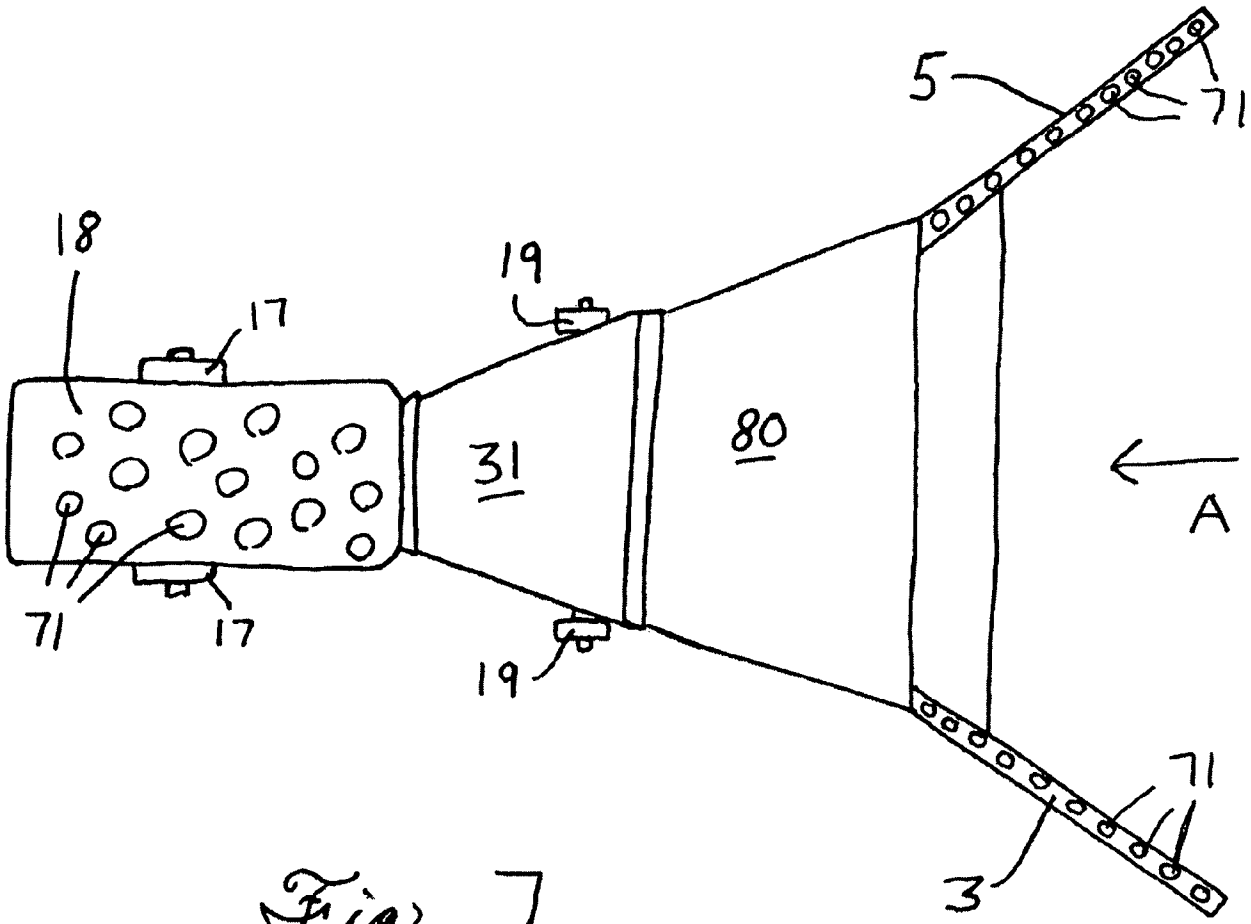
FIG. 7 is an overhead view of a wheeled device embodying concepts of the invention.

FIG. 7 is an overhead view of a wheeled device embodying the concepts of the present disclosure, wherein adapter body 31 is dimensioned so that its proximal end matches the contour of the receiver 80 at their juncture, in some embodiments provided by the invention.

Figure 8:
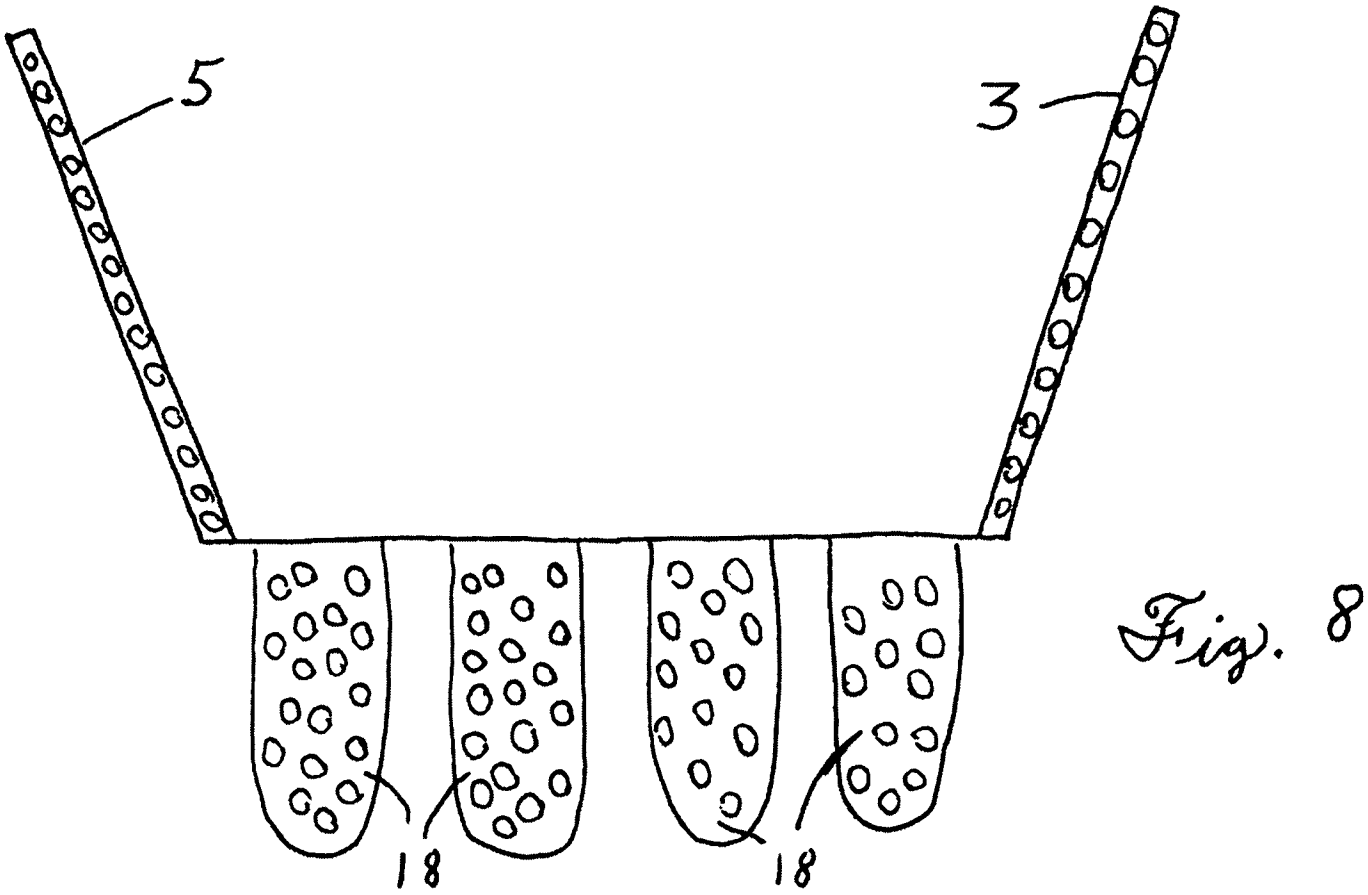
FIG. 8 is an overhead view of an article according to some alternate embodiments of the invention.

FIG. 8 is an overhead view of an article according to some alternate embodiments of the present disclosure, wherein the adapter body is simply a flat panel, board, or the like having a plurality of holes disposed therethrough and configured to receive a plurality of collection receptacles 18. In some embodiments, the flat panel shown in FIG. 8 is replaced by a box-like receiver as described herein having multiple adapter bodies attached thereto with their proximal ends being disposed openly to the volume present within the same common receiver. Such embodiments are useful for collecting larger amounts of debris, such as after clean up of the left over debris, trash, etc. from public events, including parades and the like, as a plurality of collection receptacles can be affixed to the distal ends of the plurality of adapter bodies present in such embodiments. Physical dimensions of some embodiments exemplified in FIG. 8 can be as wide as desired, for example, up to 20 feet wide, or more, and having a height dimension as high as desired, up to about 8 feet, or more in height as desired, the collection receptacles being sufficiently dimensioned to receive debris. Attachment of the collection receptacles in such embodiments can be accomplished in accordance with previous description in this disclosure, including the use of the shape of a plurality of adapters substantially as shown in FIG. 1 connected to one another or else commonly disposed on a large panel that is configured to feature a plurality of adapters at which collection receptacles 18 are attached. In lieu of a panel, any other effective construct is within this disclosure.

Figure 9:
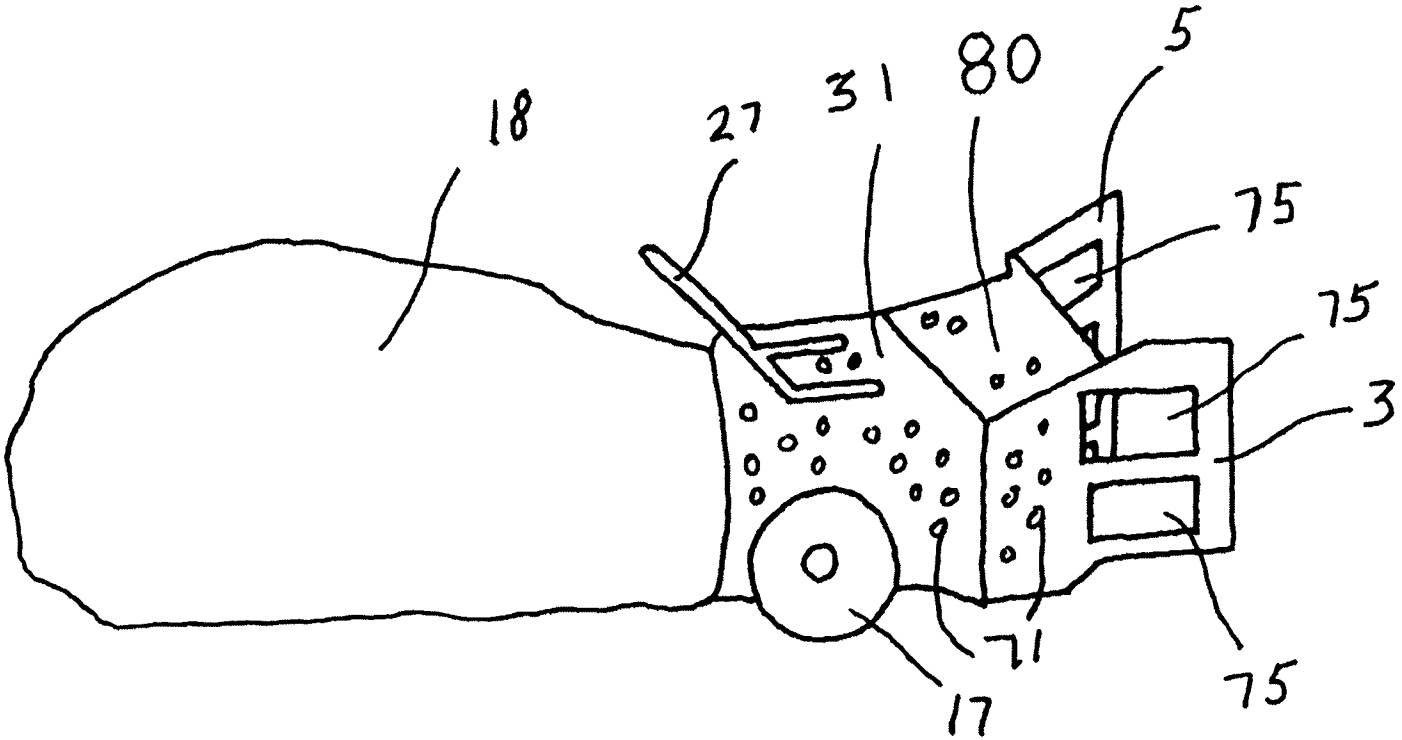
FIG. 9 is a side perspective view of an article according to some alternate embodiments of the invention.

FIG. 9 shows a side perspective view of a wheeled device 90 (FIGS. 11, 12) having a collection receptacle 18 attached to the distal end of its adapter body 31. Also shown are the respective locations of handle 27, wheel 17, receptacle 30, optionally-located holes 71, left panel 3 and right panel 5. Openings 75 are shown disposed through the left panel 3 and right panel 5, and these openings are fitted with a wire mesh or screen of any selected size but sufficient to enable air pass through panels 3, 5 when air-driven debris is forced into the intake 9 of the receiver 80. In some embodiments, panels 3, 5 are fixed in place, by virtue of their being of a single unitary construct along with receiver 80 and adapter body 31. That is, adapter body 31, receiver 80, and panels 3, 5 are all of a singular construction, provided such as by injection molding or blow molding.

Figure 10:
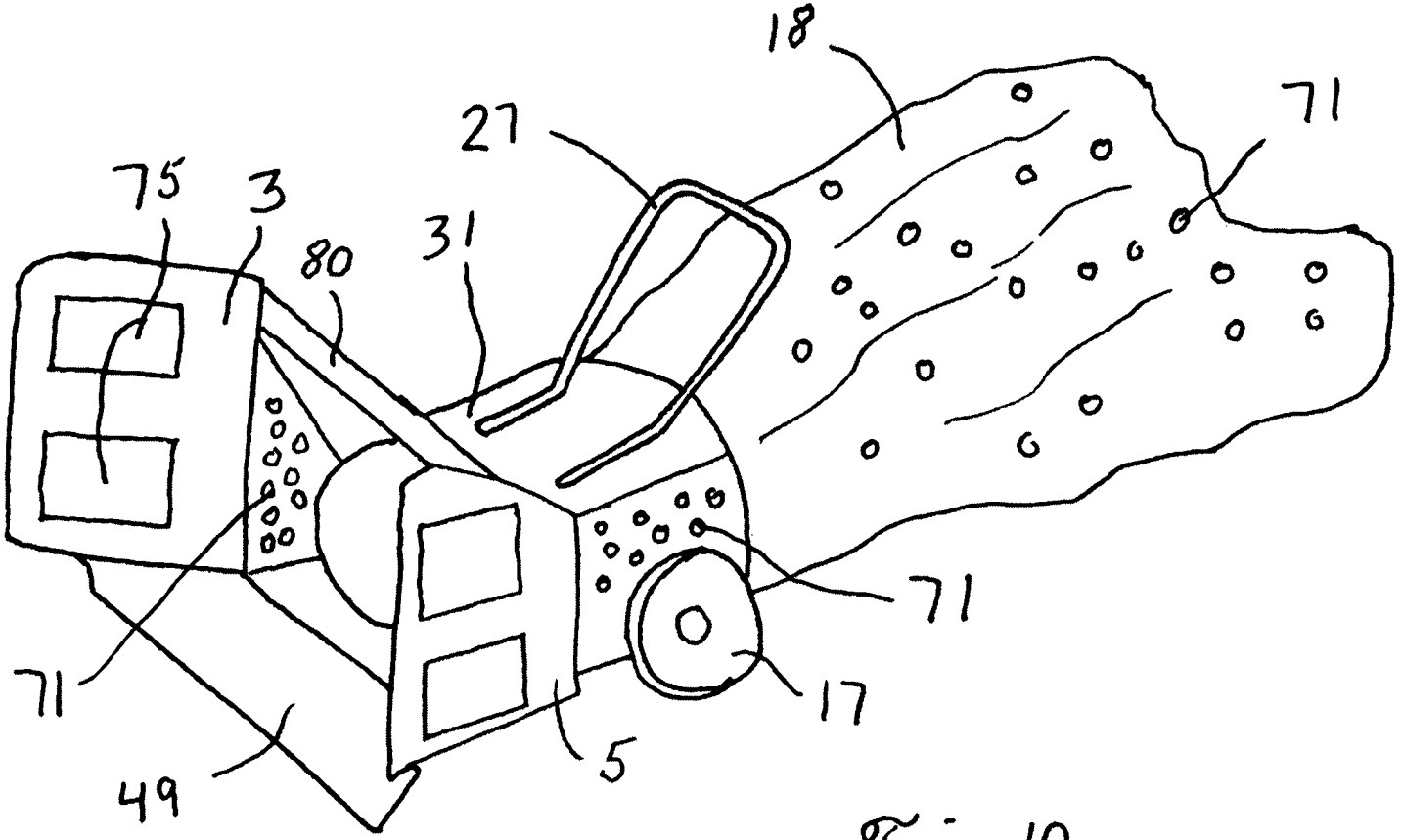
FIG. 10 is a perspective view of an article according to some alternate embodiments of the invention.

FIG. 10 shows a side perspective view of a wheeled device 90 (FIGS. 11, 12) according to some embodiments having a collection receptacle 18 attached to the distal end of its adapter body 31. Also shown are the respective locations of handle 27, adapter body 31, receiver 80, optionally-located holes 71, left panel 3, right panel 5, ramp 49, openings 75, and wheel 17.

Figure 11:
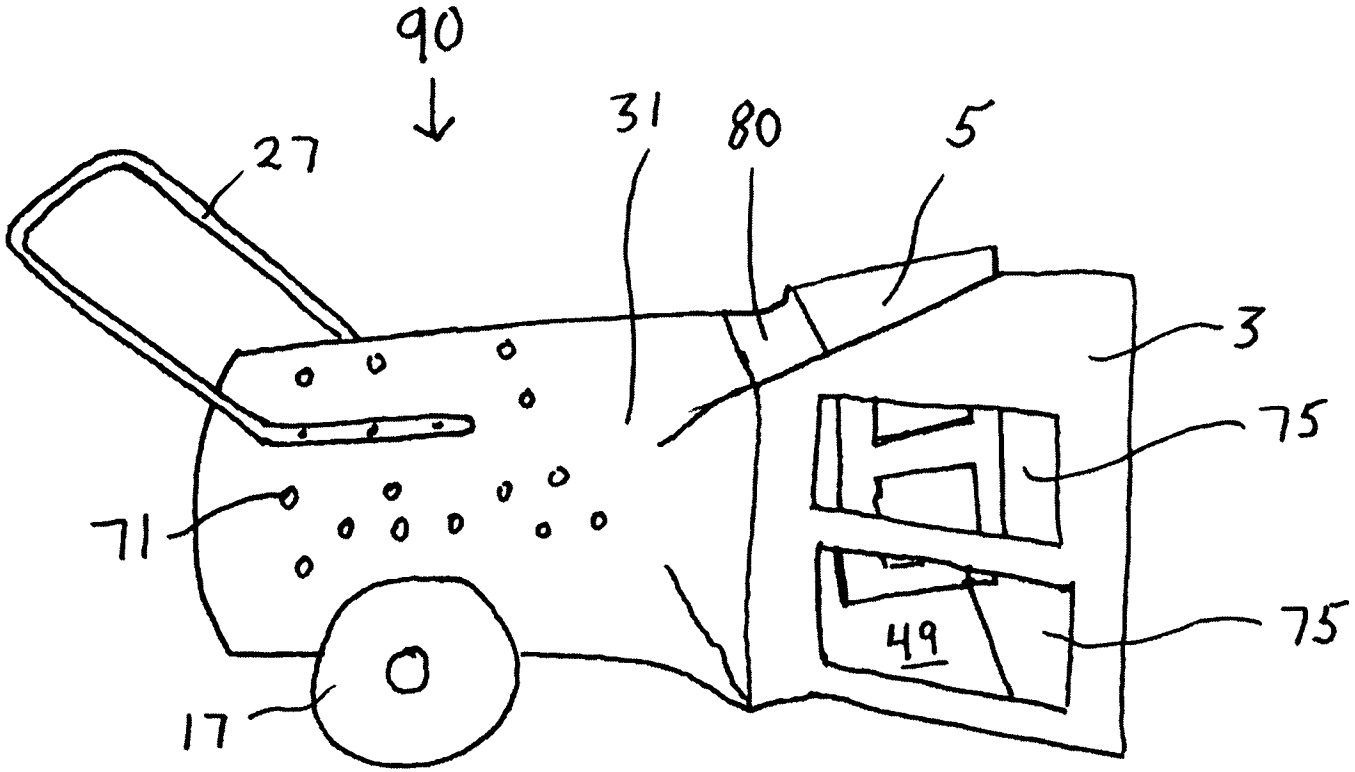
FIG. 11 is a side perspective view of an article according to some alternate embodiments of the invention.

FIG. 11 shows a wheeled device 90 according to some embodiments of the disclosure, comprising a unitary article comprising the adapter body 31, receiver 80, left panel 3, right panel 5 and ramp 49. The locations of handle 27, optionally-located holes 71, wheel 17, and openings 75 are also shown.

Figure 12:
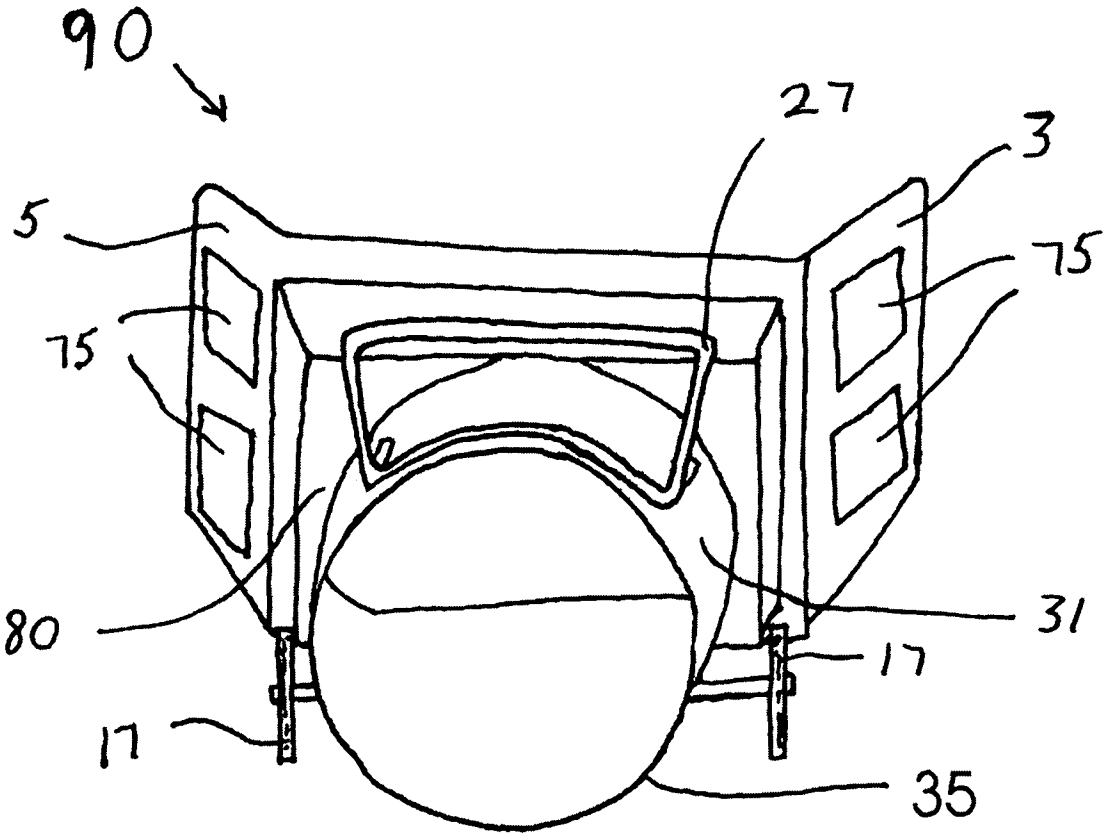
FIG. 12 is a rear perspective view of an article according to some alternate embodiments of the invention.

FIG. 12 is a rear perspective view of a wheeled device 90 according to some alternate embodiments of the invention, depicting the respective locations of handle 27, receiver 80, left panel 3, right panel 5, ramp 49, openings 75, wheels 17 and proximal end 7 of adapter body 31. In various alternate embodiments of the device 90 of FIGS. 9-13, any surface of the receiver 80, panels 3, 5 and the adapter body 31 may be optionally provided with a plurality of holes, of size and location at the option of the user, for air passage therethrough disposed through any one, or any combination including more than one of these elements, to facilitate passage of air therethrough while retaining debris. Such holes are generally between about 2 millimeters and 90 millimeters in diameter, including all values and ranges of values therebetween.

Figure 13:
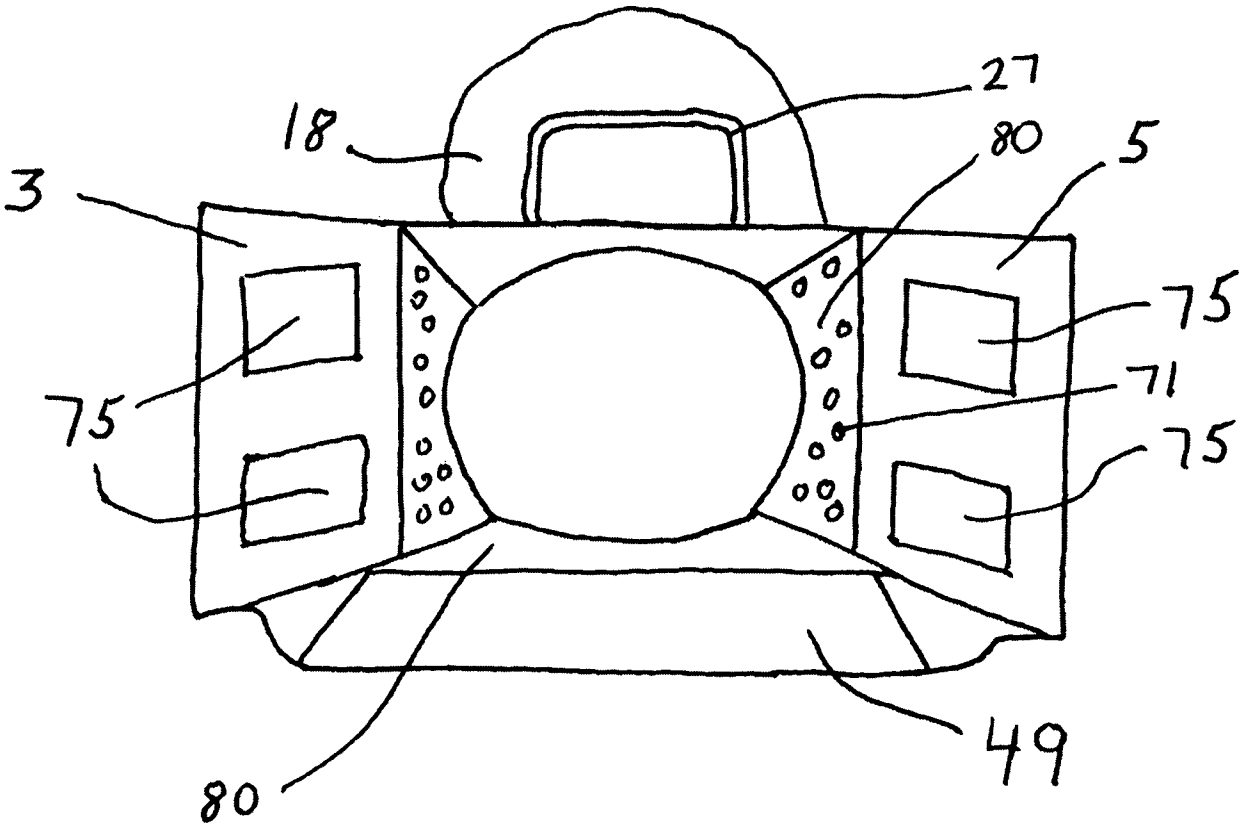
FIG. 13 is a front perspective view of an article according to some alternate embodiments of the invention.

FIG. 13 is a front perspective view a wheeled device 90 according to some alternate embodiments of the invention, depicting the respective locations of handle 27, receiver 80, left panel 3, right panel 5, optionally-located holes 71, ramp 49, openings 75, and collection receptacle 18.

Figure 14:
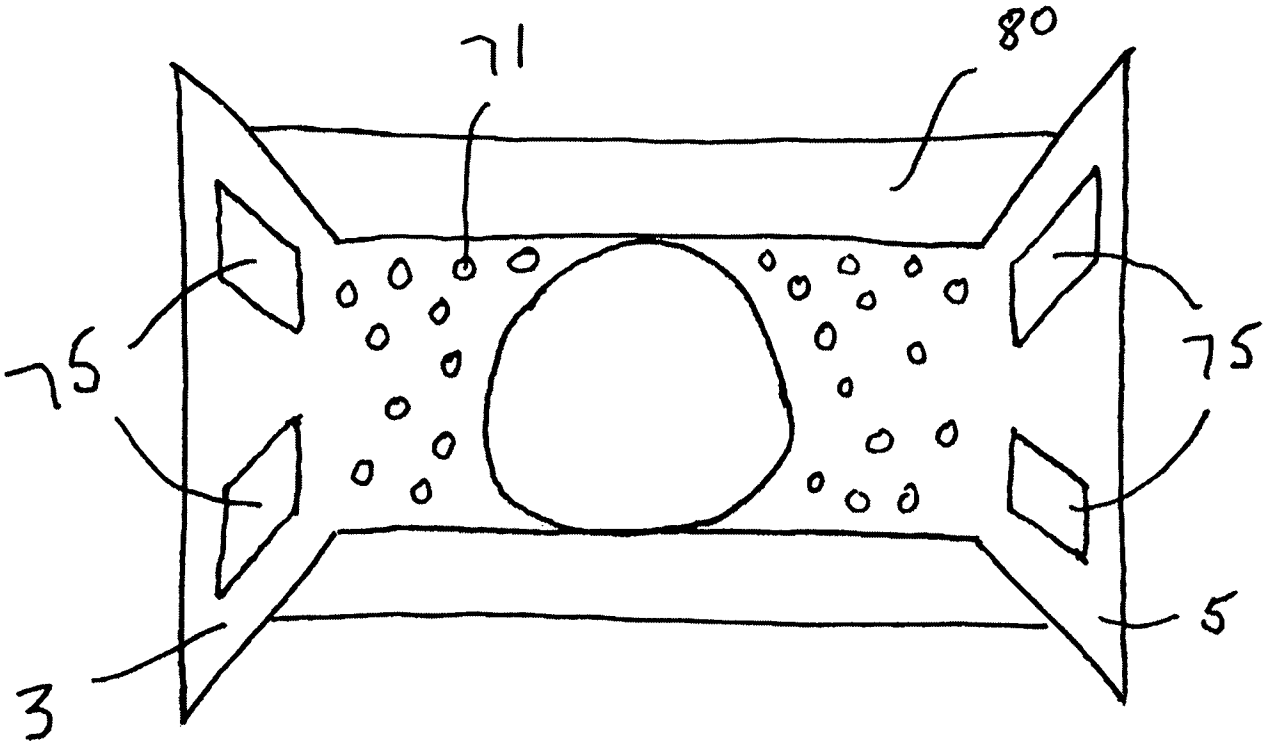
FIG. 14 is a front perspective view of an article according to some alternate embodiments of the invention.
Figure 15:
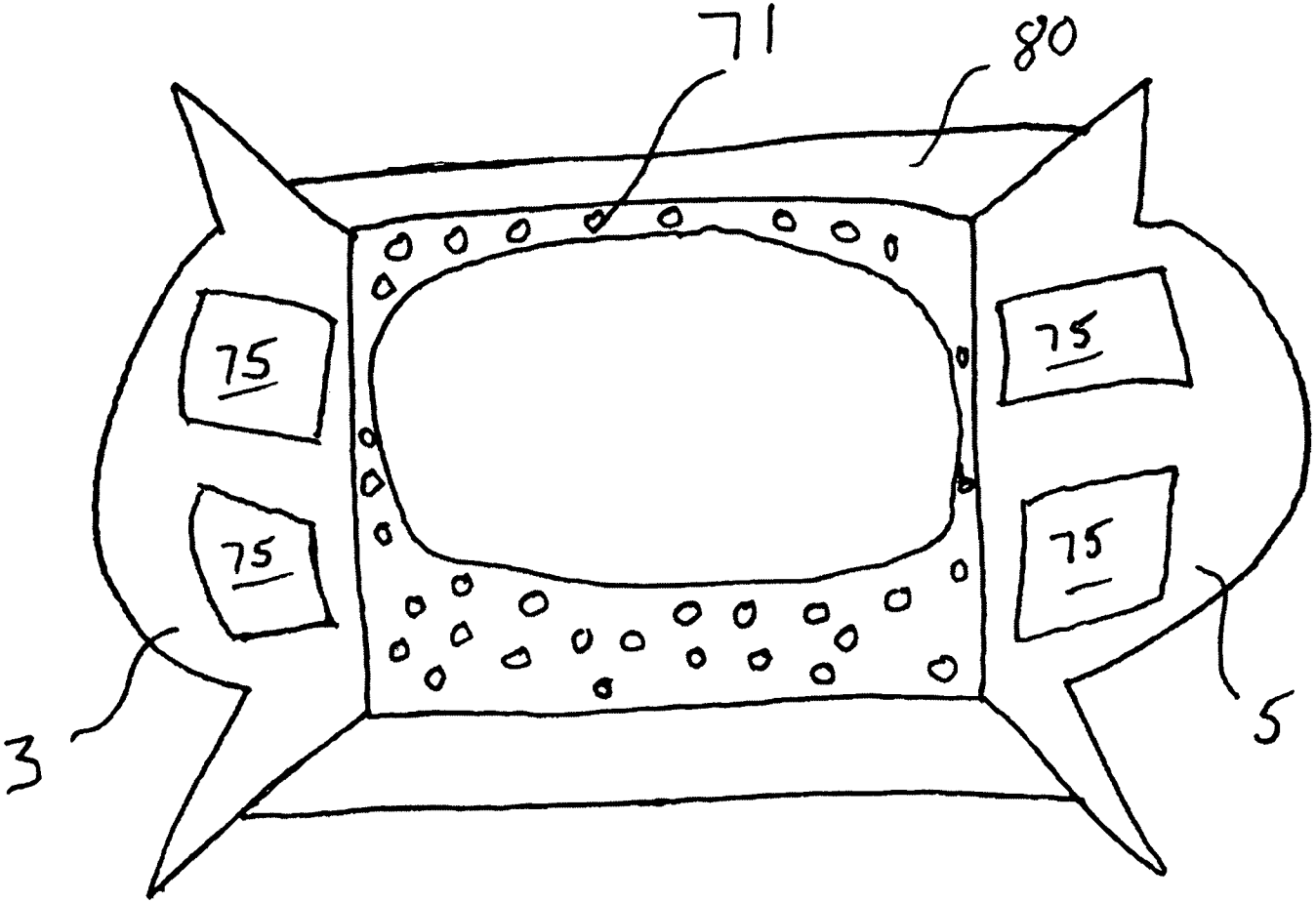
FIG. 15 is a front perspective view of an article according to some alternate embodiments of the invention.

FIGS. 14 and 15 show front perspective views of devices provided by alternate embodiments of the invention, showing the respective locations of the receiver 80, left and right panels 3, 5 and openings 75. In some embodiments, the contour of the panels is not rectangular but can have any shape desirably selected.

An article according to the invention can be made from any selected suitable material, including without limitation sheet metal, plastics, and reinforced composites such as wood, fiberglass, however, the selected material is critical insomuch as it needs only have strength sufficient to function as taught herein.

Consideration must be given to the fact that although this invention has been described and disclosed in relation to certain preferred embodiments, equivalent modifications and alterations thereof may become apparent to persons of ordinary skill in this art after reading and understanding the teachings of this specification, drawings, and the claims appended hereto. The present disclosure includes subject matter defined by any combinations of any one or more of the features described in this disclosure with any one or more than one of any other features provided in this disclosure. These combinations include the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claims so modified. These combinations also include combination of the features and/or limitations of one or more of the independent claims with features and/or limitations of another independent claims to arrive at a modified independent claim, with the remaining dependent claims in their original text or as modified per the foregoing, being read and applied to any independent claim so modified. The present invention has been disclosed and claimed with the intent to cover modifications and alterations that achieve substantially the same result as herein taught using substantially the same or similar structures, being limited only by the scope of the claims which follow.

The invention claimed is:

1. A device useful for collecting leaves and other ground debris under the influence of a forced stream of air comprising:

a) a plurality of adapter bodies connected to one another, each of said adapter bodies having a wall, a proximal end, and a distal end, with each of said ends having an opening;

b) a receiver portion having an opening suited to receiving debris and provide said debris to said proximal ends of said adapter bodies, said opening having a left side, a right side, and a bottom portion;

c) a first panel attached to said receiver at said left side of said opening;

d) a second panel attached to said receiver at said right side of said opening, said distal ends of said adapter bodies each being configured to receive and maintain a collection receptacle in a fixed position about said distal ends of said adapter bodies, said device being configured to enable debris forced to enter said opening under the influence of a stream of air to be directed into said collection receptacles.

2. A device according to claim 1 and further comprising: e) a ramp disposed at said bottom portion of said receiver and configured sufficiently to contact the surface upon which said device rests.

3. A device according to claim 2 further comprising a collection receptacle affixed to said distal end of said adapter body, said collection receptacle comprising a wall, said wall having a plurality of holes disposed therethrough.

4. A device according to claim 1, said device comprising at least two wheels by which said device is rendered mobile.

5. A device according to claim 1 wherein at least one of said panels includes a plurality of holes disposed therethrough.

6. A device according to claim 1 wherein at least one of said panels includes at least one meshed opening.

7. A device according to claim 1 wherein said wall of said adapter body includes a plurality of holes disposed therethrough.

8. A device according to claim 1 wherein said receiver includes a wall, said wall having a plurality of holes disposed therethrough.

9. A device according to claim 1 wherein said adapter body includes a tapered interior wall, said proximal end being larger in cross-sectional area than said distal end.

* * * * *